US008684397B2

(12) United States Patent
Blakeman

(10) Patent No.: US 8,684,397 B2
(45) Date of Patent: Apr. 1, 2014

(54) PERSONALIZABLE SPORT-THEMED ICE CHEST, AND METHODS OF CONSTRUCTING AND UTILIZING SAME

(76) Inventor: Ken Blakeman, Manhattan Beach, CA (US)

( * ) Notice: Subject to any disclaimer, the term of this patent is extended or adjusted under 35 U.S.C. 154(b) by 0 days.

(21) Appl. No.: 13/434,757

(22) Filed: Mar. 29, 2012

(65) Prior Publication Data

US 2012/0181203 A1 Jul. 19, 2012

Related U.S. Application Data

(63) Continuation-in-part of application No. 12/573,104, filed on Oct. 3, 2009, now Pat. No. 8,196,951, which is a continuation-in-part of application No. 29/343,089, filed on Sep. 7, 2009, now Pat. No. Des. 613,128.

(51) Int. Cl.
*B62B 5/00* (2006.01)

(52) U.S. Cl.
USPC ..... 280/655; 280/30; 280/47.27; D7/606

(58) Field of Classification Search
USPC ..... 280/655, 47.26, 87.043, 30, 79.2; D7/604, 606, 514
See application file for complete search history.

(56) References Cited

U.S. PATENT DOCUMENTS

| | | | | |
|---|---|---|---|---|
| D231,523 | S | | 4/1974 | Baker |
| 4,164,284 | A | | 8/1979 | Witt et al. |
| 4,513,895 | A | | 4/1985 | Leslie |
| D349,008 | S | | 7/1994 | Minor |
| D349,009 | S | | 7/1994 | Minor |
| D349,629 | S | | 8/1994 | Redmon |
| D349,630 | S | | 8/1994 | Redmon |
| D349,631 | S | | 8/1994 | Redmon |
| D370,391 | S | | 6/1996 | Bauer et al. |
| D371,934 | S | | 7/1996 | Cwirko |
| D378,562 | S | | 3/1997 | Miller et al. |
| 5,803,472 | A | | 9/1998 | Lien |
| D401,117 | S | * | 11/1998 | Anderson et al. ..... D7/606 |
| D409,050 | S | | 5/1999 | Anderson et al. |
| D419,389 | S | | 1/2000 | Hansen |
| D424,375 | S | | 5/2000 | D'Arrigo |
| D425,757 | S | | 5/2000 | Printz et al. |
| D452,120 | S | | 12/2001 | Brangle et al. |
| 6,474,097 | B2 | | 11/2002 | Treppedi et al. |
| 6,497,424 | B2 | | 12/2002 | Gartner |

(Continued)

FOREIGN PATENT DOCUMENTS

DE 29811256 U1 12/1998

*Primary Examiner* — Hau Phan
(74) *Attorney, Agent, or Firm* — Weiner & Burt, P.C.; Irving M. Weiner; Pamela S. Burt

(57) ABSTRACT

A personalizable sports-themed ice chest including a main housing having a lid pivotably secured to the main housing. The main housing and lid form a prolate spheroidal structure. The lid forms a first portion of the prolate spheroidal structure and is provided with design football laces. A rectangularized base contiguous with the prolate spheroidal structure has an upper portion which has a prolate spheroidal surface to mate with the prolate spheroidal structure. Two ring-like components form football stripes, each having a prolate spheroidal surface to mate with the prolate spheroidal structure to assist in holding together the upper and lower body members. Two recessed handle structures are provided in the lower body member. One or more structures are provided on the prolate spheroidal structure for the placement of logos or emblems.

20 Claims, 6 Drawing Sheets

(56) References Cited

U.S. PATENT DOCUMENTS

| | | | | |
|---|---|---|---|---|
| 6,802,149 | B1 | | 10/2004 | Albanese, Jr. et al. |
| D517,855 | S | * | 3/2006 | Krasne ..... D7/354 |
| D519,789 | S | | 5/2006 | Thiele |
| D521,322 | S | | 5/2006 | Loving |
| D530,571 | S | | 10/2006 | Hemann et al. |
| D536,219 | S | | 2/2007 | Gearing |
| 7,387,608 | B2 | | 6/2008 | Dunlop et al. |
| 7,407,032 | B1 | | 8/2008 | Chambers et al. |
| D575,965 | S | | 9/2008 | Weldon |
| D589,765 | S | | 4/2009 | Zuloff |
| 7,603,875 | B2 | | 10/2009 | Carr |
| 2002/0060438 | A1 | | 5/2002 | Gartner et al. |
| 2003/0168371 | A1 | | 9/2003 | Weimer |
| 2005/0279123 | A1 | | 12/2005 | Maldonado et al. |
| 2010/0263398 | A1 | | 10/2010 | Webb |

* cited by examiner

PERSONALIZABLE SPORT-THEMED ICE CHEST, AND METHODS OF CONSTRUCTING AND UTILIZING SAME

CROSS-REFERENCE TO RELATED APPLICATIONS

This application is a continuation-in-part of and claims priority from U.S. patent application Ser. No. 12/573,104 filed Oct. 3, 2009, now U.S. Pat. No. 8,196,951 which in turn is a continuation-in-part of and claims priority from U.S. Design Patent Application 29/343,089 filed Sep. 7, 2009 now U.S. Pat. No. D613,128.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates to a novel and unique personalizable sports-themed ice chest, and methods of constructing and utilizing same.

More particularly, the present invention relates to a novel and unique personalizable sports-themed ice chest having a main ice chest housing and a selectively openable and closable lid member which form a prolate spheroidal structure, the selectively openable and closable lid member forms a first portion of the prolate spheroidal structure and is provided with design football laces thereon, and a rectangularized base is contiguous with the prolate spheroidal structure, and methods of constructing and utilizing same.

It is a desideratum of the present invention to avoid the animadversions of conventional ice chests, and at the same time to provide a very convenient and unique personalizable sports-themed ice chest.

SUMMARY OF THE INVENTION

The present invention provides personalizable sports-themed ice chest, comprising: a main ice chest housing having a selectively openable and closable lid member pivotably secured to said main ice chest housing; said main ice chest housing and said selectively openable and closable lid member form a prolate spheroidal structure; said selectively openable and closable lid member forms a first portion of said prolate spheroidal structure and is provided with design football laces thereon; a rectangularized base contiguous with said prolate spheroidal structure; said rectangularized base having an upper portion which has a prolate spheroidal surface to mate with and support said prolate spheroidal structure; said prolate spheroidal structure having an upper body member and a lower body member; two ring-like components forming football stripes; each said ring-like component having a prolate spheroidal surface to mate with and be contiguous with said prolate spheroidal structure to assist in holding together said upper body member and said lower body member; two recessed handle structures provided in said lower body member; and one or more predetermined structures on said prolate spheroidal structure for the placement thereon of a logo or emblem.

It is a primary object of the present invention to provide a personalizable sports-themed ice chest as described hereinabove.

A further object of the present invention is to provide an ice chest as described above which includes: a sealing structure between said upper and lower body members; said sealing structure including a rubber-like sealing member; and said sealing structure including a channel member and a mating raised member which are designed and dimensioned to press said rubber-like sealing member therebetween.

Yet another object of the present invention is to provide an ice chest as described above which includes: screws and pins transversing a plane where said upper and lower body members meet to assist in holding together said upper and lower body members; and said ring-like football stripe components blocking said screws and pins from external viewing thereof.

Yet another object of the present invention is to provide an ice chest as described above which includes a collapsible pull handle mechanism connected to the main ice chest housing, and one or more predetermined areas on the main ice chest housing for the placement thereon of a personalizable logo or emblem.

Another object of the invention is to provide an ice chest as described above including a drain device disposed in said rectangularized base.

Another object of the invention is to provide an ice chest as described above wherein said rectangularized base has a substantially planar bottom portion which is provided with a plurality of depending bump members upon which the ice chest is supported.

Another object of the invention is to provide an ice chest as described above including rotary wheels connected to said rectangularized base.

Another object of the invention is to provide an ice chest as described above including: a channel structure passing through said prolate spheroidal structure; a collapsible handle mechanism secured to said ice chest; and said collapsible handle mechanism being disposed at least partially in said channel structure passing through said prolate spheroidal structure.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

Figure 1:
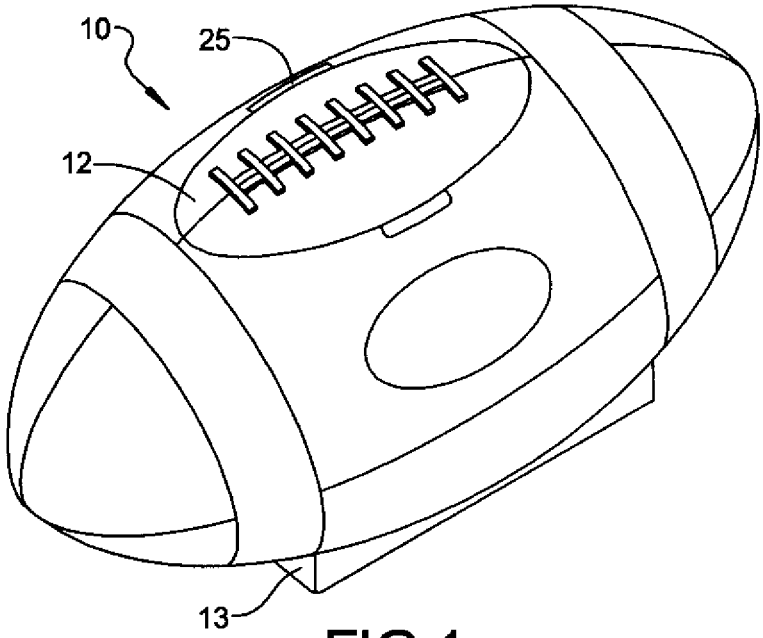
FIG. 1 is a perspective view of a first embodiment of the present invention.

Like components of the two embodiments described and illustrated herein are designated with like reference numerals.

Figure 2:
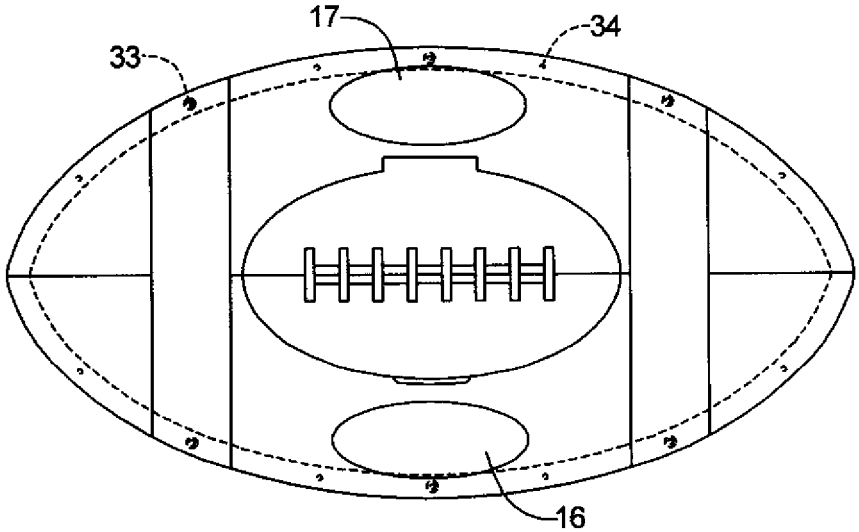
FIG. 2 is a top plan view of the apparatus depicted in FIG. 1.
Figure 3:
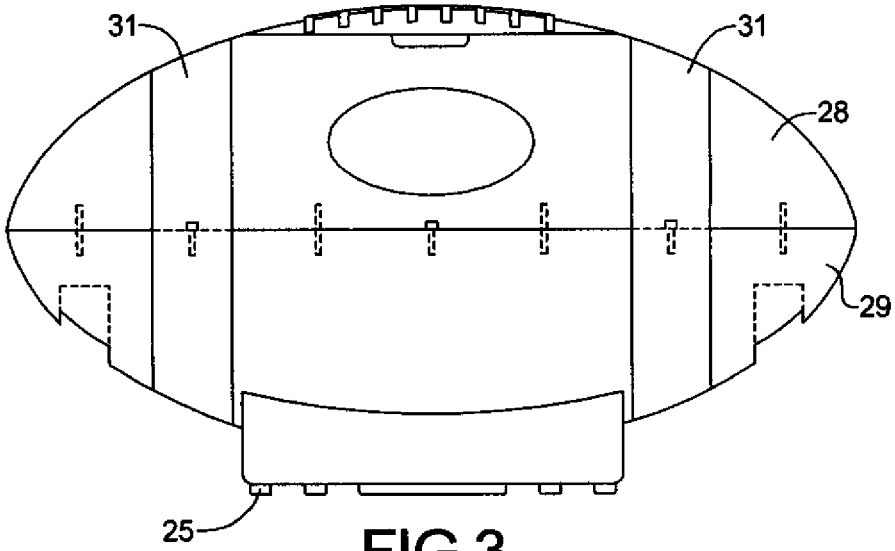
FIG. 3 is a front elevational view of the FIG. 1 apparatus with some components shown in phantom.
Figure 4:
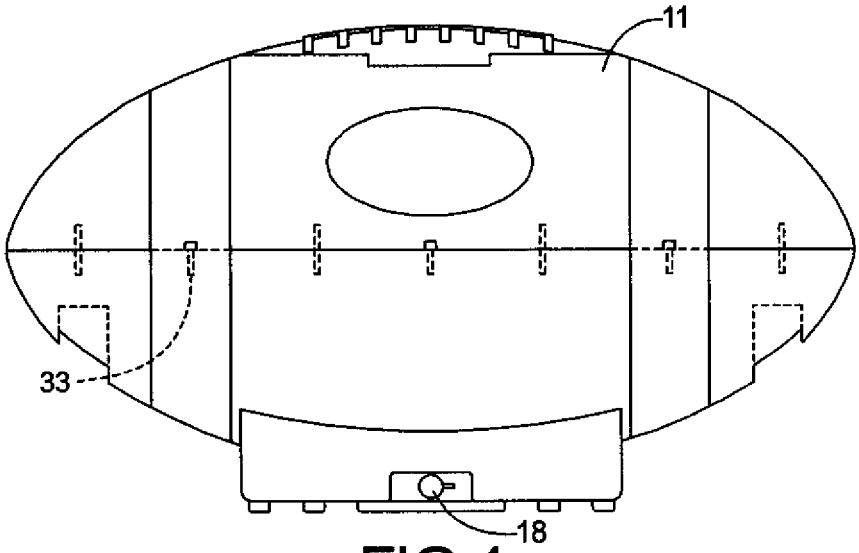
FIG. 4 is a rear elevational view of the FIG. 1 apparatus with some components shown in phantom.
Figure 5:
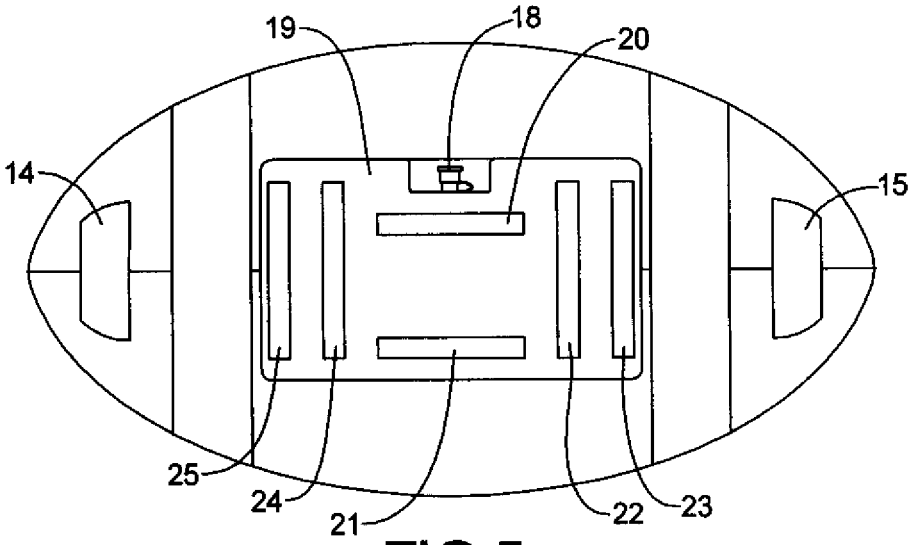
FIG. 5 shows a bottom view of the FIG. 1 apparatus.
Figure 6:
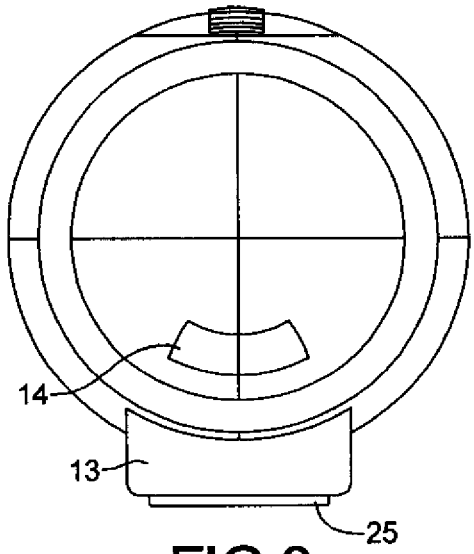
FIG. 6 is side elevational view of the FIG. 1 apparatus.
Figure 13:
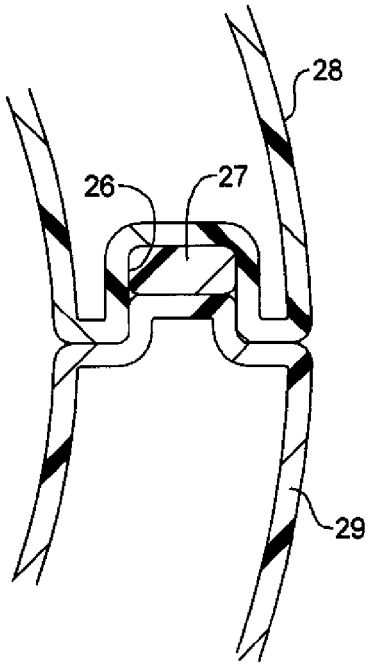
FIG. 13 shows the rubber sealing arrangement.

With reference to FIGS. 1-6 and 13, there is shown a personalizable sports-themed ice chest or cooler 10 in accordance with a first embodiment of the invention.

The chest 10 includes a main ice chest housing 11 having a selectively openable and closable lid member 12 pivotably secured to the main ice chest housing 11.

The main ice chest housing 11 and said selectively openable and closable lid member 12 are formed in a personalizable sports related shape, which in this case is the shape of a football with a rectangularized base 13.

The cooler 11 is provided with: recessed handles 14 and 15; a plurality of logo area portions or plates 16 and 17; a drain 18; a flat bottom portion 19 with elevated bump components 20, 21, 22, 23, 24 and 25; an area 26 for a rubber seal 27; a rubber seal 27 between the upper cooler body member 28 and the lower cooler body member 29; internal connection points 30 between the upper and lower body members 28 and 29; separate stripe pieces 31 and 32 each designed as a ring/loop for disposable around the cooler body to assist in holding the upper and lower body members 28 and 29 together; screws 33 and pins 34 between the upper and lower body members 28 and 29; and a lid hinge 35.

The stripe components 31 and 32 are preferably separate hard plastic components that are disposed around the cooler body like rubber bands to help hold the upper and lower body members 28 and 29 together, and hide at least some of the screw heads and pins.

The logo plates 16 and 17 also hide some of the screw heads and pins.

The screws 33 and pins 34 provide additional holding power for the seam between the upper and lower body members 28 and 29.

The cooler 11 has a one-inch wall thickness, and the pins 34 are set within such wall thickness.

The screws 33 are accessed behind the logo plates 16 and 17 and the stripe components 31 and 32 so that after the logo plates and stripe components are assembled the screws are not visible from outside the cooler.

Figure 7:
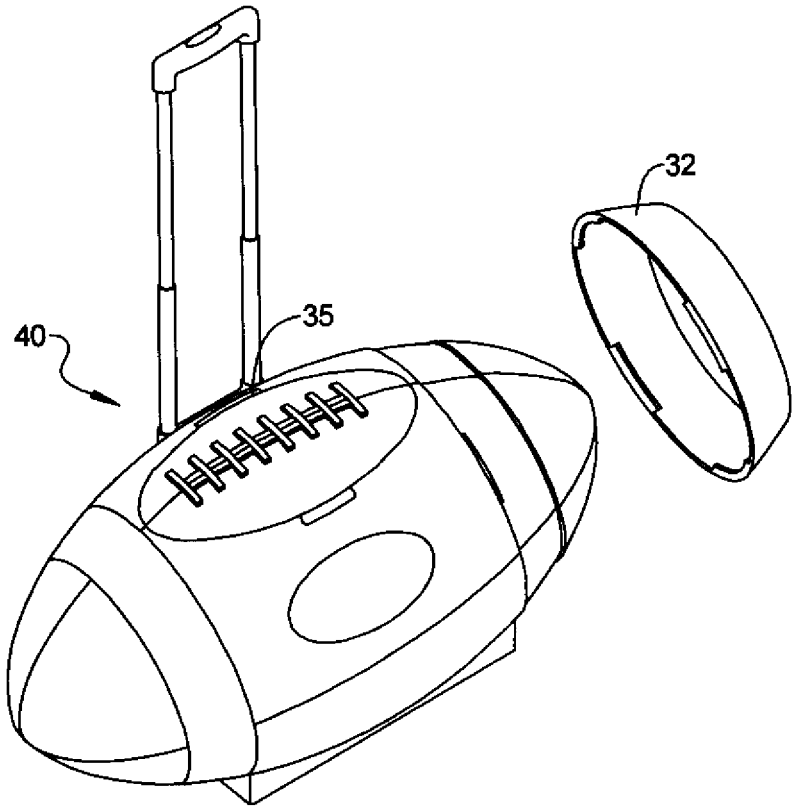
FIG. 7 is a perspective view of a second embodiment of the present invention showing one unassembled separate stripe portion component.
Figure 8:
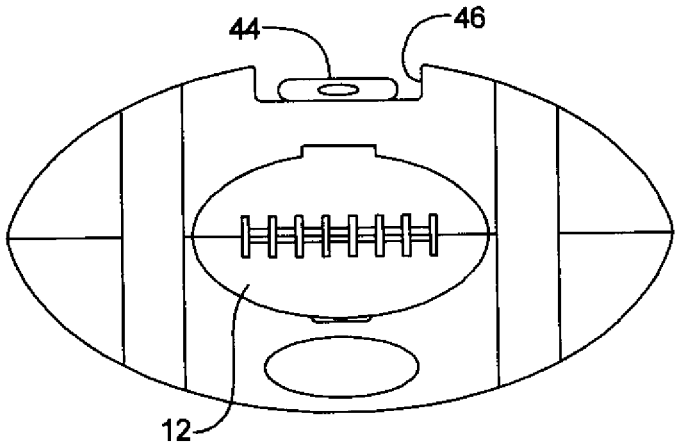
FIG. 8 is a top plan view of the FIG. 7 apparatus.
Figure 9:
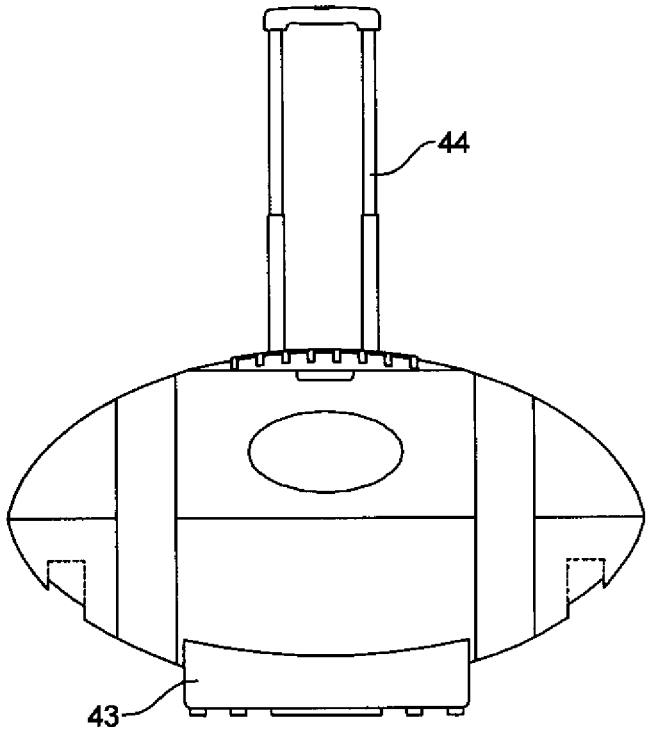
FIG. 9 is front elevational view of the FIG. 7 apparatus.
Figure 10:
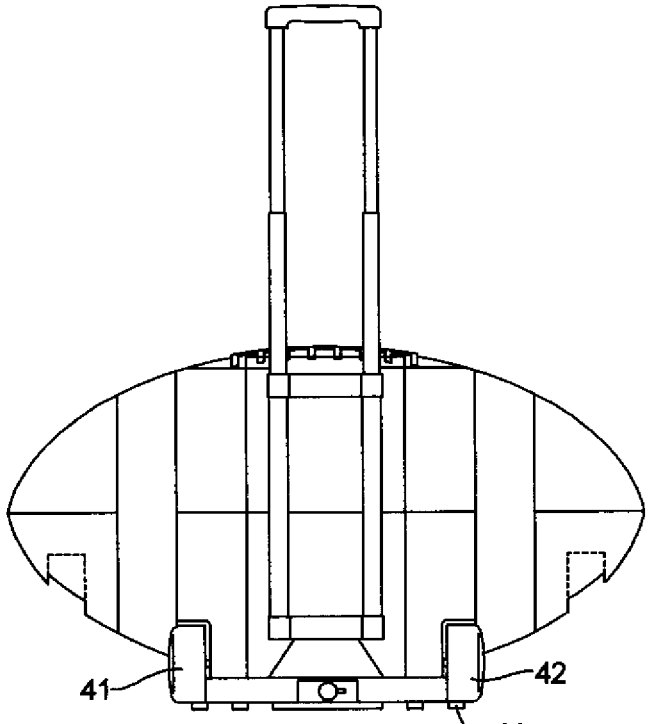
FIG. 10 is rear elevational view of the FIG. 7 apparatus.
Figure 11:
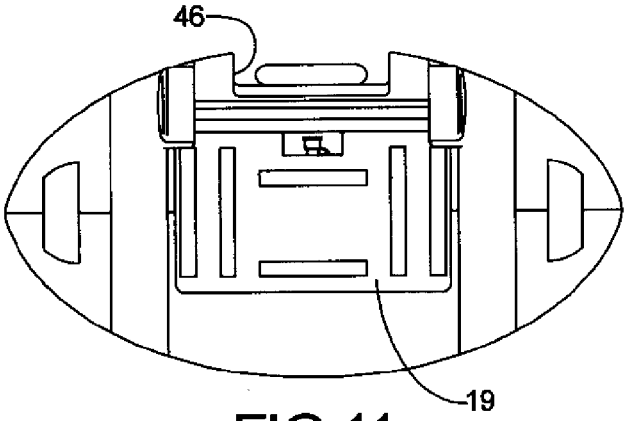
FIG. 11 is bottom view of the FIG. 7 apparatus.
Figure 12:
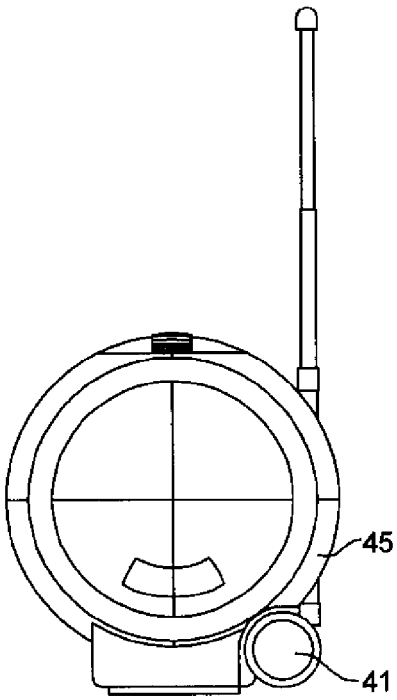
FIG. 12 is right side elevational view of the FIG. 7 apparatus.

With reference to FIGS. 7-13, there is shown a personalizable sports-themed ice chest or cooler 40 in accordance with a second embodiment of the invention.

Wheels 41 and 42 rotatably secured to the rectangularized base 43 enable said personalizable sports-themed ice chest 40 to be rolled by a user of said personalizable sports-themed ice chest 40.

A collapsible pull handle mechanism 44 is connected to said main ice chest housing 45 in a channel 46 through the football shaped housing 45.

Fabrication may be of any suitable ice chest material.

There have been illustrated in the accompanying drawings and described hereinabove only two possible unique and novel embodiments of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A personalizable sports-themed ice chest, comprising:

a main ice chest housing having a selectively openable and closable lid member pivotably secured to said main ice chest housing;

said main ice chest housing and said selectively openable and closable lid member form a prolate spheroidal structure;

said selectively openable and closable lid member forms a first portion of said prolate spheroidal structure and is provided with design football laces thereon;

a rectangularized base contiguous with said prolate spheroidal structure;

said rectangularized base having an upper portion which has a prolate spheroidal surface to mate with and support said prolate spheroidal structure;

said prolate spheroidal structure having an upper body member and a lower body member;

two ring-like components forming football stripes disposed around said main ice chest housing;

each said ring-like component having a prolate spheroidal surface to mate with and be contiguous with said prolate spheroidal structure to assist in holding together said upper body member and said lower body member;

two recessed handle structures provided in said lower body member; and one or more predetermined structures on said prolate spheroidal structure for the placement thereon of a logo or emblem.

2. The personalizable sports-themed ice chest of claim 1, including:

a sealing structure between said upper and lower body members;

said sealing structure including a rubber-like sealing member; and said sealing structure including a channel member and a mating raised member which are designed and dimensioned to press said rubber-like sealing member therebetween.

3. The personalizable sports-themed ice chest of claim 2, including:

screws and pins transversing a plane where said upper and lower body members meet to assist in holding together said upper and lower body members; and said ring-like football stripe components blocking said screws and pins from external viewing thereof.

4. The personalizable sports-themed ice chest of claim 3, including:

a drain device disposed in said rectangularized base.

5. The personalizable sports-themed ice chest of claim 3, including:

a channel structure passing through said prolate spheroidal structure;

a collapsible handle mechanism secured to said ice chest; and said collapsible handle mechanism being disposed at least partially in said channel structure passing through said prolate spheroidal structure.

6. The personalizable sports-themed ice chest of claim 2, including:

a drain device disposed in said rectangularized base.

7. The personalizable sports-themed ice chest of claim 2, wherein:

said rectangularized base has a substantially planar bottom portion which is provided with a plurality of depending bump members upon which the ice chest is supported.

8. The personalizable sports-themed ice chest of claim 2, including:

rotary wheels connected to said rectangularized base.

9. The personalizable sports-themed ice chest of claim 2, including:

a channel structure passing through said prolate spheroidal structure;

a collapsible handle mechanism secured to said ice chest; and said collapsible handle mechanism being disposed at least partially in said channel structure passing through said prolate spheroidal structure.

10. The personalizable sports-themed ice chest of claim 1, including:

screws and pins transversing a plane where said upper and lower body members meet to assist in holding together said upper and lower body members; and said ring-like football stripe components blocking said screws and pins from external viewing thereof.

11. The personalizable sports-themed ice chest of claim 10, including:

a drain device disposed in said rectangularized base.

12. The personalizable sports-themed ice chest of claim 10, wherein:

said rectangularized base has a substantially planar bottom portion which is provided with a plurality of depending bump members upon which the ice chest is supported.

13. The personalizable sports-themed ice chest of claim 12, including:

a channel structure passing through said prolate spheroidal structure;

a collapsible handle mechanism secured to said ice chest; and said collapsible handle mechanism being disposed at least partially in said channel structure passing through said prolate spheroidal structure.

14. The personalizable sports-themed ice chest of claim 10, including:

a channel structure passing through said prolate spheroidal structure;

a collapsible handle mechanism secured to said ice chest; and said collapsible handle mechanism being disposed at least partially in said channel structure passing through said prolate spheroidal structure.

15. The personalizable sports-themed ice chest of claim 1, including:

a drain device disposed in said rectangularized base.

16. The personalizable sports-themed ice chest of claim 15, including:

a channel structure passing through said prolate spheroidal structure;

a collapsible handle mechanism secured to said ice chest; and said collapsible handle mechanism being disposed at least partially in said channel structure passing through said prolate spheroidal structure.

17. The personalizable sports-themed ice chest of claim 1, wherein:

said rectangularized base has a substantially planar bottom portion which is provided with a plurality of depending bump members upon which the ice chest is supported.

18. The personalizable sports-themed ice chest of claim 17, including:

rotary wheels connected to said rectangularized base.

19. The personalizable sports-themed ice chest of claim 1, including:

rotary wheels connected to said rectangularized base.

20. The personalizable sports-themed ice chest of claim 1, including:

a channel structure passing through said prolate spheroidal structure;

a collapsible handle mechanism secured to said ice chest; and said collapsible handle mechanism being disposed at least partially in said channel structure passing through said prolate spheroidal structure.

* * * * *